US009995235B2

(12) United States Patent
Kettenacker et al.

(10) Patent No.: US 9,995,235 B2
(45) Date of Patent: Jun. 12, 2018

(54) METHOD AND DEVICE FOR MONITORING AN ENGINE CONTROL UNIT

(75) Inventors: Guenter Kettenacker, Steinheim (DE); Volker Pitzal, Waldstetten/Wissgoldingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 2127 days.

(21) Appl. No.: 12/328,980

(22) Filed: Dec. 5, 2008

(65) Prior Publication Data

US 2009/0187330 A1 Jul. 23, 2009

(30) Foreign Application Priority Data

Jan. 18, 2008 (DE) ..... 10 2008 005 154

(51) Int. Cl.
*F02D 41/14* (2006.01)

(52) U.S. Cl.
CPC ..... *F02D 41/1497* (2013.01)

(58) Field of Classification Search
CPC ..... F02D 41/1497; F02D 2250/18; F02D 2200/1004
USPC ..... 701/106, 84, 87, 104; 123/434, 478, 123/406.23, 305, 350, 352, 357, 399, 480, 123/488; 73/114.15
See application file for complete search history.

(56) References Cited

U.S. PATENT DOCUMENTS

| | | | | |
|---|---|---|---|---|
| 5,992,379 | A * | 11/1999 | Brudigam et al. | 123/339.1 |
| 6,386,180 | B1 * | 5/2002 | Gerhardt et al. | 123/350 |
| 6,671,611 | B1 | 12/2003 | Peltier | |
| 6,814,060 | B1 * | 11/2004 | Solomons et al. | 123/501 |
| 6,845,305 | B1 * | 1/2005 | Raftari et al. | 701/22 |
| 7,213,448 | B1 * | 5/2007 | Huseman et al. | 73/114.15 |
| 7,347,184 | B2 * | 3/2008 | Kuroda et al. | 123/434 |
| 2003/0204302 | A1 * | 10/2003 | Amano | 701/102 |
| 2005/0172930 | A1 | 8/2005 | Pitzal et al. | |
| 2006/0086337 | A1 * | 4/2006 | Nickel | 123/335 |
| 2006/0142924 | A1 * | 6/2006 | Nakagawa et al. | 701/110 |
| 2007/0016356 | A1 * | 1/2007 | Kolb et al. | 701/103 |
| 2007/0056563 | A1 * | 3/2007 | Kanne et al. | 123/478 |
| 2008/0047523 | A1 * | 2/2008 | Chen et al. | 123/295 |
| 2008/0103673 | A1 * | 5/2008 | Pfaeffle et al. | 701/103 |
| 2008/0140280 | A1 | 6/2008 | Kerejewski et al. | |
| 2009/0187330 | A1 * | 7/2009 | Kettenacker et al. | 701/106 |

FOREIGN PATENT DOCUMENTS

| | | | |
|---|---|---|---|
| DE | 10300194 | A1 | 10/2003 |
| DE | 10359306 | A1 | 7/2005 |
| DE | 102005010456 | A1 | 9/2006 |
| EP | 1 018 600 | | 7/2000 |

(Continued)

*Primary Examiner* — Sizo Vilakazi

(74) *Attorney, Agent, or Firm* — Norton Rose Fulbright US LLP; Gerard Messina

(57) ABSTRACT

A method for plausibilization of an engine control function for an internal combustion engine includes: provision of injection parameters with which an injection of fuel into cylinders of the internal combustion engine is controlled on the basis of a torque that is to be realized; estimation of an actual torque of the internal combustion engine as a function of the injection parameters; and evaluation of the actual torque as a function of the torque that is to be realized, in order to plausibilize the engine control function.

7 Claims, 2 Drawing Sheets

(56) References Cited

FOREIGN PATENT DOCUMENTS

| | | |
|---|---|---|
| RU | 2219510 | 12/2003 |
| RU | 2289720 | 12/2006 |
| SU | 1768793 | 10/1992 |

* cited by examiner

METHOD AND DEVICE FOR MONITORING AN ENGINE CONTROL UNIT

CROSS-REFERENCE TO RELATED APPLICATIONS

The present application claims priority to Application No. 10 2008 005 154.3, filed in the Federal Republic of Germany on Jan. 18, 2008, which is expressly incorporated herein in its entirety by reference thereto.

FIELD OF THE INVENTION

The present invention relates to a method and a device for monitoring an engine control device for controlling an internal combustion engine.

BACKGROUND INFORMATION

In order to monitor the proper functioning of an engine control unit that provides injection parameters for the injection of fuel into the cylinders in order to set a torque of an internal combustion engine, in particular a self-igniting internal combustion engine, a separate monitoring unit is conventionally provided. The separate monitoring unit also calculates injection parameters independently of the engine control unit, on the basis of provided input quantities such as the driver's desired torque or the target torque that is to be set, calculated by a torque controller. From the control signals provided to the injection valves by the engine control unit, the injection parameters used as a basis in the engine control unit are determined, and these are compared to the injection parameters calculated in the monitoring unit in a suitable manner. As a function of the result of the comparison, it is determined whether the engine control unit is functioning properly or not.

In order to determine the injection parameters in the engine control unit, as a rule, several hundred or several thousand parameters and characteristic fields are used that are stored in the engine control unit. These characteristic fields must therefore also be provided in the monitoring unit in order to calculate the corresponding injection parameters there in the same manner. This requires a corresponding storage capacity to be present also in the monitoring unit. In addition, depending on the engine system the characteristic fields in the engine control unit are adapted to the specific customer in accordance with desired characteristics of the internal combustion engine, so that the monitoring unit must be programmed in a manner corresponding to the engine control unit, or must have access in some other manner to the characteristic fields in order to determine the injection parameters for the monitoring of the proper functioning of the engine control unit.

Therefore, in the implementation of such a system it is necessary for both the engine control unit and the monitoring unit to be correspondingly adapted to each other, which however entails an additional expense in the implementation of the monitoring unit for an engine control unit.

SUMMARY

Example embodiments of the present invention provide a method for monitoring an engine control unit and a monitoring unit for an engine control unit that realize a monitoring function that can be carried out independent of the characteristic fields implemented in the engine control unit.

According to a first aspect, a method is provided for the plausibilization of an engine control function for an internal combustion engine. The method includes: provision of injection parameters with which an injection of fuel into the cylinder of the internal combustion engine can be controlled on the basis of a prespecified torque that is to be realized; and estimation of an actual torque of the internal combustion engine as a function of the injection parameters; evaluation of the actual torque as a function of the torque that is to be realized, in order to plausibilize the engine control function.

An aspect of the method described above is to determine the actual torque only from the injection parameters with which the engine is controlled. As injection parameters, for example injection duration, injection quantity, and/or injection profile may be taken. Using the estimated actual torque obtained in this manner, the proper functioning of an engine control function is determined by evaluating the estimated actual torque with reference to the torque that is to be realized. The back-calculation of the actual torque that is to be expected from the injection parameters with which the engine is controlled takes place independently of the characteristic fields stored in the engine control unit, and is carried out only on the basis of the provided injection parameters, as well as engine-type-specific characteristic fields or previously trained characteristic fields. This is possible because the demands on precision for the monitoring of the engine control unit are not high, because it is necessary to recognize and limit only dangerous states resulting from accelerating engines in the low partial-load range, due to undesirably excessively high indicated torque. The method has the advantage that the engine control unit includes functional parameterization of the continuous monitoring, and that it is not necessary to adapt this monitoring to a customer engine application, so that the expense of implementing the engine control function can be reduced.

The method is based on the assumption that the efficiency of an injection is a function substantially of the angle of the center of the injection, so that the overall torque provided by the internal combustion engine can be estimated via the individual torques provided by the cylinders. The indicated efficiency of several different types of internal combustion engine does not show great differences in efficiency, because the piston movement results from a rotational motion, and the speed angular progression is therefore always the same. The achievable precision is therefore directly connected to the expense that one is willing to make for the adaptation to the internal combustion engine being used. It is thus possible, with low demands on precision, to provide simple characteristic fields having only a few support points, and not to use characteristic field interpolation to determine values formed in the characteristic field.

The actual torque may be estimated by determining the injection duration of each cylinder on the basis of the injection parameters, the individual torque provided by the respective cylinder being determined as a function of the injection duration and efficiency of the cylinder, and the actual torque of the internal combustion engine being estimated from the individual torques.

The efficiency can be determined as a function of the angle of the center of injection, corresponding to a center of an angular range between the beginning of the injection and the end of the injection.

In addition, with the aid of the injection duration an injection quantity can be determined, and the respective individual torque can be determined from the injection quantity and the efficiency.

In addition, it can be provided that the injection quantity be corrected using a pressure wave correction factor (in common-rail systems) or using a cam shape correction factor (in pump-nozzle systems).

In addition, in the evaluation of the actual torque an error can be determined if the actual torque lies outside a range of tolerance around the torque that is to be realized.

The injection parameters may be provided in the form of control signals for controlling injection valves of the cylinders.

According to another aspect, a monitoring unit is provided for the plausibilization of an engine control function for an internal combustion engine. The monitoring unit includes an interface for receiving injection parameters that control an injection of fuel into the cylinder of the internal combustion engine on the basis of a prespecified torque that is to be realized, an estimator unit for estimating an actual torque of the internal combustion engine as a function of the injection parameters, and an evaluation unit for evaluating the actual torque as a function of the torque that is to be realized, in order to plausibilize the engine control function.

According to another aspect, a computer program is provided that contains a program code that executes one of the above methods when it is run on a data processing unit.

Further features and aspects of example embodiments of the present invention are described in more detail below with reference to the appended Figures.

DETAILED DESCRIPTION

Figure 1:
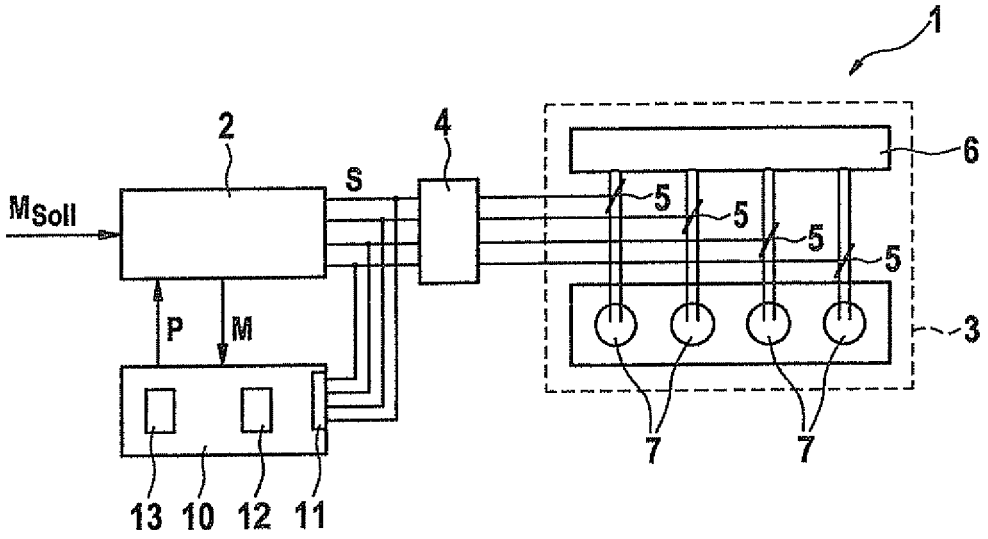
FIG. 1 shows a monitoring system for monitoring the function of an engine control unit for operating an internal combustion engine according to an example embodiment of the present invention.

FIG. 1 shows a block diagram illustrating a monitoring system according to an example embodiment of the present invention. The overall system 1 includes an engine control unit 2 for controlling an internal combustion engine 3. Internal combustion engine 3 is fashioned for example as a self-igniting internal combustion engine that is operated by the specification of injection parameters, such as the time of injection, the duration of injection, and the injection profile, controlled by control signals S provided by engine control unit 2. For this purpose, engine control unit 2 provides control signals S to an end stage 4 that controls injection valves 5 allocated to cylinders 7 in accordance with control signals S.

Injection valves 5 can be opened in order to allow a fuel-air mixture to flow from what is referred to as a common-rail section 6 (chamber for providing the air-fuel mixture under high pressure) into the allocated cylinders 7. Control signals S of engine control unit 2 are used to implement or to produce a target torque $M_{Soll}$, prespecified to engine control unit 2, in internal combustion engine 3.

Figure 2:
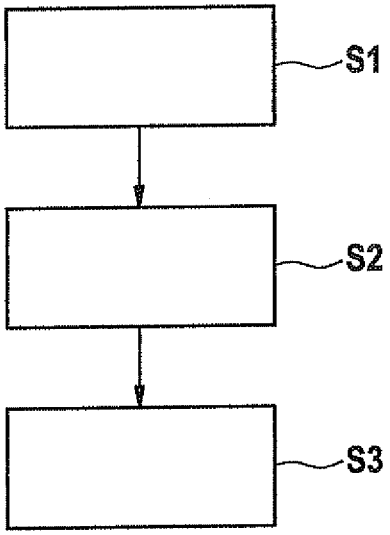
FIG. 2 shows a flow diagram for illustrating the method according to an example embodiment of the present invention.

Engine control unit 2 is coupled to a monitoring unit 10 that is preferably operated independent of engine control unit 2 and that is intended to monitor the functioning of engine control unit 2, as is shown in the flow diagram of FIG. 2. Alternatively, the monitoring can also be realized in engine control unit 2, e.g. as a microcontroller unit. Monitoring unit 10 is connected to engine control unit 2 in order to receive, via an interface 11, control signals S (step S1) that are provided by engine control unit 2. Control signals S determine the injection timing, the injected quantity, and the injection profile. Monitoring unit 10 evaluates control signals S in an evaluation unit 12, in accordance with a procedure described below (step S2), and also receives an indication of target torque $M_{Soll}$ that is to be set in internal combustion engine 2 by engine control unit 2. The engine control unit determines, for example in a corresponding controller, a torque M that is to be realized in order to determine whether engine control unit 2 is operating properly via an evaluation (step S3), e.g. by a comparison of the torque M that is to be realized with an actual torque $M_{Ist}$ estimated in an estimator unit 13. Alternatively, engine control unit 2 of monitoring unit 10 may provide an indication of a torque that is to be realized, with which the actual torque is compared.

The estimated actual torque $M_{IST}$ can be evaluated with respect to the requested torque M that is to be realized, by checking whether the actual torque $M_{IST}$ is situated within a range of tolerance of for example +/−10% around the torque M that is to be realized. Corresponding to the result of the evaluation, a plausibility signal P is provided by a monitoring unit 10, e.g. to engine control unit 2, in order for example to activate an emergency function that for example limits the engine torque and/or signals that a malfunction has occurred.

Instead of the control signals, monitoring unit 10 can also provide indications of the injection parameters before these parameters are converted into corresponding control signals in engine control unit 2.

The estimation of actual torque $M_{IST}$ of internal combustion engine 3 from the control signals is based on the assumption that the efficiency of an injection, and therewith a provided individual torque, is essentially a function of the angle of the center of the injection, and that in this manner the corresponding torque can be calculated for each injection into a cylinder 7. The overall torque results from the sum of the individual torques of individual cylinders 7.

Figure 3:
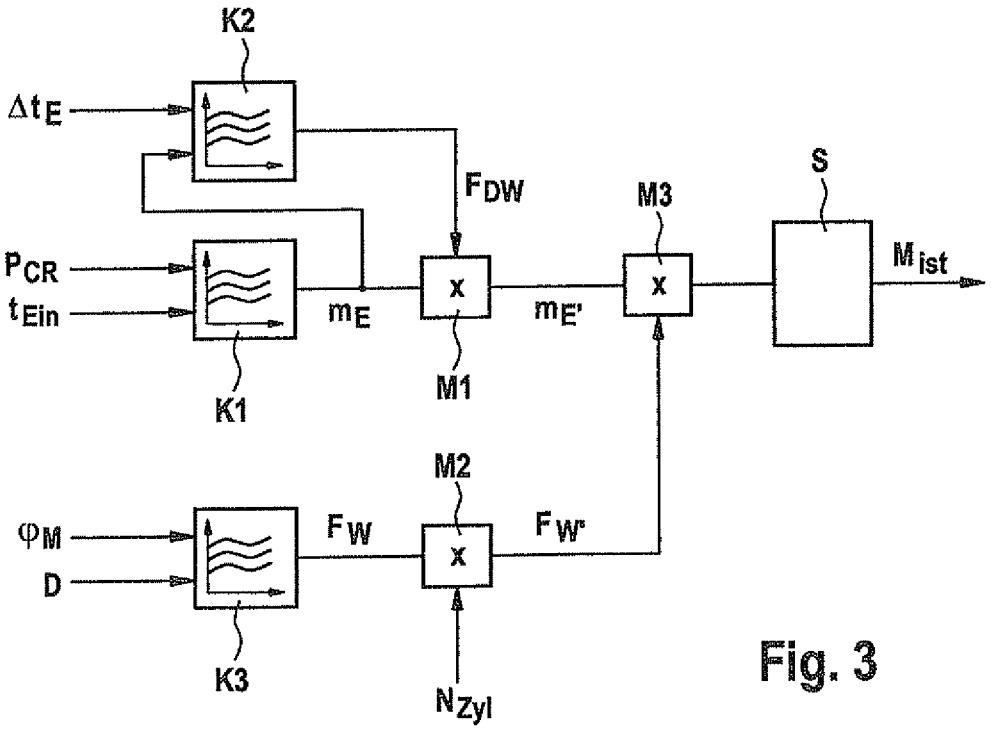
FIG. 3 shows a functional representation for the estimation of the actual torque of the internal combustion engine on the basis of the injection parameters.

In engine system 1, as shown in FIG. 1, the method for plausibilization of the functioning of the engine control unit is executed in accordance with the functional diagram shown in FIG. 3. First, the quantity $m_E$ of fuel injected into cylinders 7 allocated to the control signal is determined, without pressure wave correction, from the pressure in common-rail section 6 $P_{CR}$ and the control duration $T_{EIN}$ of one of the control signals, with the aid of a first characteristic field K1. If a different engine design is used, such as a pump-nozzle design, for injecting fuel into cylinders 7, instead of the pressure $P_{CR}$ the engine rotational speed n can be used, because there the injected quantity $m_E$ is approximately proportional to the engine rotational speed.

The injected quantity $m_E$ is supplied, together with a time indication $\Delta t_E$ indicating the temporal distance of the current injection from the preceding injection, to a second characteristic field K2 in order to provide a pressure wave correction factor $F_{DW}$ (in common-rail systems). In a pump-nozzle system, due to the cam shape a correction factor is instead used that is a function of the crankshaft angle. The pressure wave correction factor is supplied to a first multiplication element M1. In first multiplication element M1, the uncorrected injected quantity $m_E$ is subjected to pressure wave correction factor $F_{DW}$, yielding a corrected injected quantity $m_E'$.

In addition, an injection angle at the injection center is determined from the angle at the time at which the injection valve is opened and the angle at the time at which the injection valve is closed, in accordance with the following equation:

$$\varphi_M = \varphi(\text{control beginning}+\text{opening time})+\varphi(\text{control end}+\text{closing time})/2.$$

The beginning of the controlling corresponds to the time at which the respective control signal S indicates an opening of the injection valve. Analogously, the end of the controlling corresponds to the time at which the respective control signal S indicates a closing of the injection valves. The opening time and the closing time correspond to the time delay with which the respective injection valve reacts to a corresponding control signal.

An efficiency factor $F_W$ per cylinder 7 is determined from injection angle $\varphi_M$ in the injection center and rotational speed n of internal combustion engine 3, via a third characteristic field K3. In a second multiplication element 2, efficiency factor $F_W$ is multiplied by the number of cylinders $N_{ZYL}$, so that the third characteristic field K3 does not have to be changed if the number of cylinders is different but the injection valves or injectors are the same. Third characteristic field K3 can be defined according to the engine type, thus taking into account properties determined by engine geometries and the type of engine.

If it is desired to increase the precision of the estimation of the actual torque from the control signals, third characteristic field K3 for each individual internal combustion engine 3 in which monitoring unit 10 is ultimately used can be trained in a training process. In such a training process, the torque M that is to be realized and the control signals S are brought into a relation to one another and are mapped as a characteristic field.

Alternatively, given lower requirements on precision, the characteristic field may be filled with a constant value, such as 1.5 Nm/(mg/stroke). The result $F_W'$ of the multiplication of the number of cylinders $N_{ZYL}$ by the efficiency factor $F_W$ is multiplied, in a third multiplication element M3, by the corrected injected quantity $m_E'$, in order to obtain in this manner the individual torque determined per partial injection (per cylinder). The individual torques are stored in a summation field S having a number of storage locations for the individual torques that corresponds to the number of cylinders $N_{ZYL}$. Summation field S permanently adds the individual torques stored therein, and outputs their sum as estimated actual torque $M_{IST}$.

It can be provided that the determined, estimated actual torque $M_{IST}$ is capable of being displayed by connecting a display unit to monitoring unit 10. By dividing actual torque $M_{IST}$ by the torque M that is to be realized, a factor can be generated that indicates whether the redundant calculation of torque at the respective operating point is situated above or below the torque M that is to be realized.

An advantage of the method described above is that the monitoring of the functioning of engine control unit 2 can be carried out without also realizing the characteristic fields of engine control unit 2 in monitoring unit 10.

The efficiency characteristic field, i.e. third characteristic field K3, can be defined such that for all injection angles in the center of injection up to 10° before top dead center it indicates optimal efficiency, e.g. 1.5 Nm/(mg/stroke), and from there to e.g. 90° after top dead center it decreases in linear fashion to 1.5 Nm/(mg/stroke).

In the implementation of monitoring unit 10, second characteristic field K2 can at first neutrally output 1 as a factor, and can be correspondingly adapted in a subsequent adaption process in order to carry out a pressure wave correction. The adaption takes place in accordance with the desired degree of precision of the engine torque estimation, in a training process or during operation of internal combustion engine 3.

What is claimed is:

1. A method for plausibilization of an engine control function provided by an engine control unit for an internal combustion engine, comprising:

providing injection parameters with which an injection of fuel into cylinders of the internal combustion engine is controlled on the basis of a torque that is to be realized;

estimating an actual torque of the internal combustion engine as a function of the injection parameters, wherein the estimating is performed using a predefined characteristic field;

evaluating by a monitoring unit the actual torque as a function of the torque that is to be realized, in order to plausibilize the engine control function provided by the engine control unit, wherein a plausibility signal is generated as a result of the evaluation, and wherein the monitoring unit is different from the engine control unit; and providing the plausibility signal from the monitoring unit to the engine control unit;

wherein an error is determined during the evaluation of the actual torque if the actual torque is situated outside a predefined, non-zero range of tolerance around the torque that is to be realized, and wherein the plausibility signal indicates the error.

2. The method according to claim 1, wherein the actual torque is estimated by determining an injection duration of each cylinder on the basis of the injection parameters, an individual torque provided by the respective cylinder being determined as a function of the injection duration and an efficiency of the cylinder, the actual torque of the internal combustion engine being estimated from the individual torques.

3. The method according to claim 2, wherein an efficiency is determined as a function of an injection center angle, corresponding to a center of an angular range between a beginning of the injection and an end of the injection.

4. The method according to claim 2, wherein an injected quantity is determined with the aid of the injection duration, the respective individual torque being determined from the injected quantity and an efficiency.

5. The method according to claim 4, wherein the injected quantity is corrected in accordance with a cam shape correction factor.

6. The method according to claim 1, wherein the injection parameters are provided in the form of control signals for controlling injection valves of the cylinders.

7. A monitoring unit for plausibilization of an engine control function provided by an engine control unit for an internal combustion engine, wherein the monitoring unit is different from the engine control unit, comprising:

an interface adapted to receive injection parameters, with which the one injection of fuel into cylinders of the internal combustion engine is controlled on the basis of a torque that is to be realized;

an estimator unit adapted to estimate an actual torque of the internal combustion engine as a function of the injection parameters, wherein the estimation is performed using a predefined characteristic field; and an evaluation unit adapted to evaluate the actual torque as a function of the torque that is to be realized, in order to plausibilize the engine control function provided by the engine control unit, wherein the evaluation unit generates a plausibility signal as a result of the evaluation and provides the plausibility signal to the engine control unit, and wherein an error is determined during the evaluation of the actual torque if the actual torque is situated outside a predefined, non-zero range of tolerance around the torque that is to be realized, and wherein the plausibility signal indicates the error.

* * * * *